US007008335B2

(12) United States Patent
Kim

(10) Patent No.: US 7,008,335 B2
(45) Date of Patent: Mar. 7, 2006

(54) GOLF TEE

(75) Inventor: Chang-Hak Kim, Seoul (KR)

(73) Assignee: Lee Chang Enterprise Co., Ltd., Seoul (KR)

( * ) Notice: Subject to any disclaimer, the term of this patent is extended or adjusted under 35 U.S.C. 154(b) by 0 days.

(21) Appl. No.: 10/789,349

(22) Filed: Feb. 26, 2004

(65) Prior Publication Data

US 2005/0159248 A1 Jul. 21, 2005

(30) Foreign Application Priority Data

Jan. 15, 2004 (KR) ..... 20-2004-0001070 U

(51) Int. Cl.
*A63B 57/00* (2006.01)

(52) U.S. Cl. ..... 473/391; 473/387

(58) Field of Classification Search ..... 473/386–403
See application file for complete search history.

(56) References Cited

U.S. PATENT DOCUMENTS 1,278,147 A * 9/1918 Hess ..... 473/391
1,730,046 A * 10/1929 Stow ..... 473/391
2,011,203 A * 8/1935 Kazuo ..... 473/396
2,747,768 A * 5/1956 Raines ..... 473/391
3,220,727 A * 11/1965 Legan ..... 473/386
4,660,837 A * 4/1987 Bressie ..... 473/386
5,085,431 A * 2/1992 McGuire ..... 473/386

* cited by examiner

*Primary Examiner*—Steven Wong
(74) *Attorney, Agent, or Firm*—Cohen, Pontani, Lieberman & Pavane

(57) ABSTRACT

A golf tee comprising a burying device including a concave head portion for retaining a golf ball, and a first cone extending from the head portion by a predetermined length. At least one stacked inserting device I provided which includes a second cone made of a thin sheet and arranged to receive therein the first cone of said burying device. At least one blocking protrusion is formed in an outer circumference of the second cone. A spring is compressed between said burying device and said at least one stacked inserting device. A coupling device is coupled with the burying device. The coupling device includes a cylindrical body with openings in an upper portion and a lower portion thereof sized for said at least one stacked inserting device to pass therethrough. A blocking jaw is formed in an inner circumference of said lower portion of the cylindrical body and arranged to engage said at least one blocking protrusion to block passage of said at least one stacked inserting device through the opening in said lower portion, and at least one groove is formed in the blocking jaw sized for said at least one blocking protrusion to be released from said blocking jaw when said at least one groove and said at least one blocking protrusion are coincidingly aligned with each other so that said at least one stacked inserting device can pass out of the opening in said lower portion under urging of said compressed spring.

12 Claims, 6 Drawing Sheets

GOLF TEE

BACKGROUND OF THE INVENTION

1. Field of the Invention

The present invention relates to a golf tee, and more particularly, to a golf tee which is made of a thin sheet material to thus minimize the shock generated when a drive shot is performed so that a golfer hardly feels resistance and in which a plurality of inserting devices are stacked and with which a burying device is integrated so that it is not necessary to additionally carry a burying apparatus.

2. Prior Art

In general, golf starts in a tee ground that is a starting point of a game. At this time, a golfer buries a golf tee in a predetermined position of the tee ground, puts a golf ball on the buried golf tee, and performs a drive shot. When the golfer hits the golf ball, shock resistance is generated in a club head to thus deteriorate the hit sense of the golfer and to reduce a flying distance. Therefore, it is understood that the golf tee must be made of a thin sheet having small resistance. However, golf tees made of thin sheets are not used. This is because the golf tees made of the thin sheets are transformed due to the pressure applied when the golf tees are buried. Therefore, since almost golf tees are made of wood or light plastic whose inside is filled so as not to be transformed due to the applied pressure, it is not possible to reduce the shock resistance. It is possible to bury the golf tees made of the thin sheets without being transformed by including additional burying equipments for burying the golf tees made of the thin sheets. However, it is necessary to carry additional burying equipments other than the golf tees.

Furthermore, the shock resistance generated when the golfer hits the golf ball makes the golf tee scatter or lost. Therefore, the golfer must make unnecessary efforts in order to collect the scattered golf tee and additionally carries supplementary golf tees for fear that the golf tee would be lost.

SUMMARY OF THE INVENTION

Therefore, the present invention is made to solve such problems. It is an object of the present invention to provide a golf tee made of a thin sheet material to thus minimize shock so that a golfer hardly feels resistance when he or she hits a golf ball.

It is another object of the present invention to provide a golf tee integrated with a burying device in order to prevent the golf tee from being transformed when it is buried.

It is still another object of the present invention to provide a golf tee capable of stacking a plurality of inserting devices once so as to use the golf tee a plurality of times without carrying supplementary golf tees and collecting lost golf tees.

In order to achieve the objects, one aspect of the present invention is directed to a golf tee comprising a burying device including a concave head portion for retaining a golf ball, and a first cone extending from the head portion by a predetermined length. At least one stacked inserting device I provided which includes a second cone made of a thin sheet and arranged to receive therein the first cone of said burying device. At least one blocking protrusion is formed in an outer circumference of the second cone. A spring is compressed between said burying device and said at least one stacked inserting device. A coupling device is coupled with the burying device. The coupling device includes a cylindrical body with openings in an upper portion and a lower portion thereof sized for said at least one stacked inserting device to pass therethrough. A blocking jaw is formed in an inner circumference of said lower portion of the cylindrical body and arranged to engage said at least one blocking protrusion to block passage of said at least one stacked inserting device through the opening in said lower portion, and at least one groove is formed in the blocking jaw sized for said at least one blocking protrusion to be released from said blocking jaw when said at least one groove and said at least one blocking protrusion are coincidingly aligned with each other so that said at least one stacked inserting device can pass out of the opening in said lower portion under urging of said compressed spring.

BRIEF DESCRIPTION OF THE DRAWINGS

These and other features, aspects, and advantages of the present invention will become better understood with regard to the following description, appended claims, and accompanying drawings, in which like components are referred to by like reference numerals. In the drawings:

DETAILED DESCRIPTION OF THE PREFERRED EMBODIMENT

A golf tee according to a preferred embodiment of the present invention will now be described in detail with reference to the attached drawings.

Figure 1:
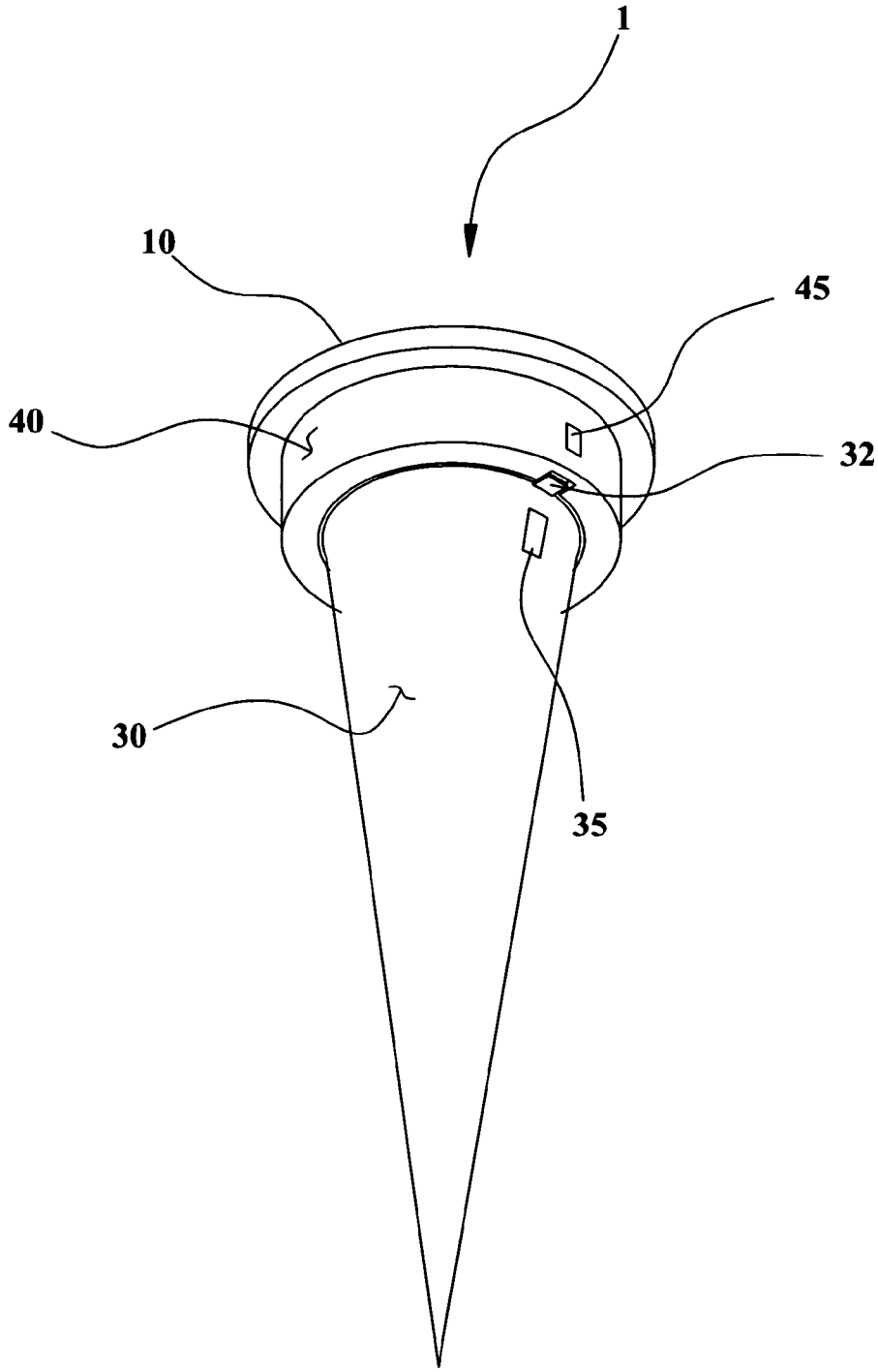
FIG. 1 is a perspective view illustrating a golf tee according to a preferred embodiment of the present invention.
Figure 2:
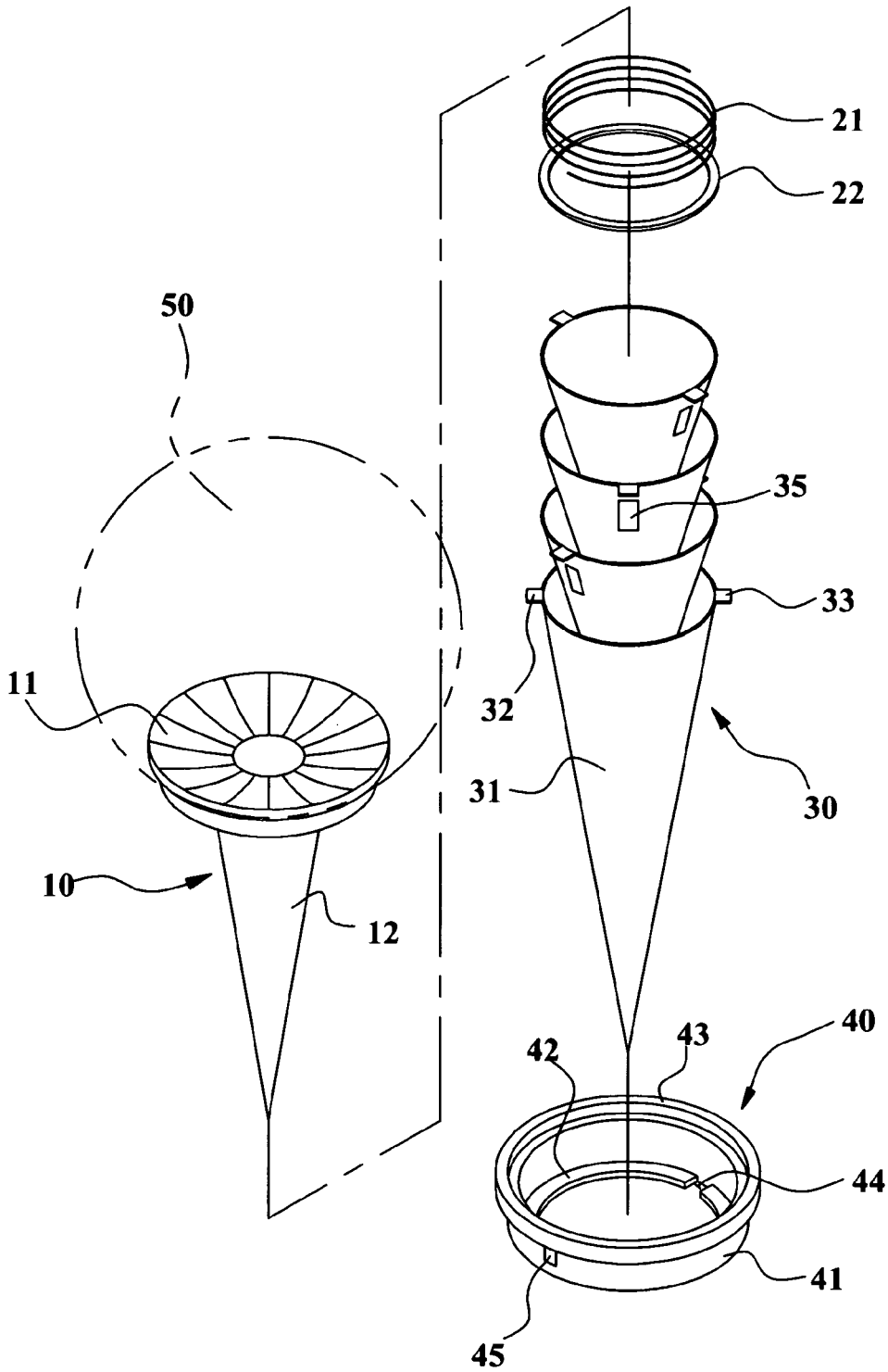
FIG. 2 is an exploded perspective view illustrating the golf tee according to the preferred embodiment of the present invention.
Figure 3:
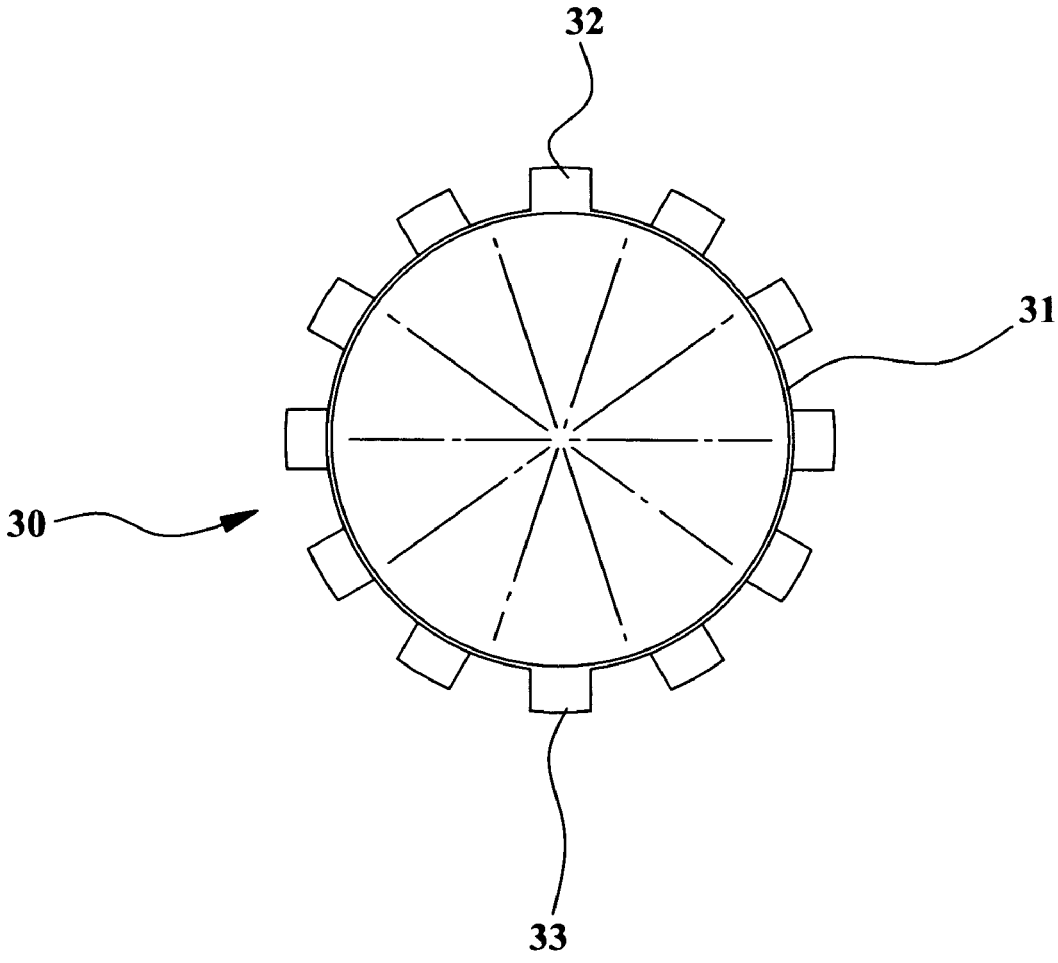
FIG. 3 is a plan view illustrating that at least one inserting device is stacked in the golf tee according to the preferred embodiment of the present invention.
Figure 4:
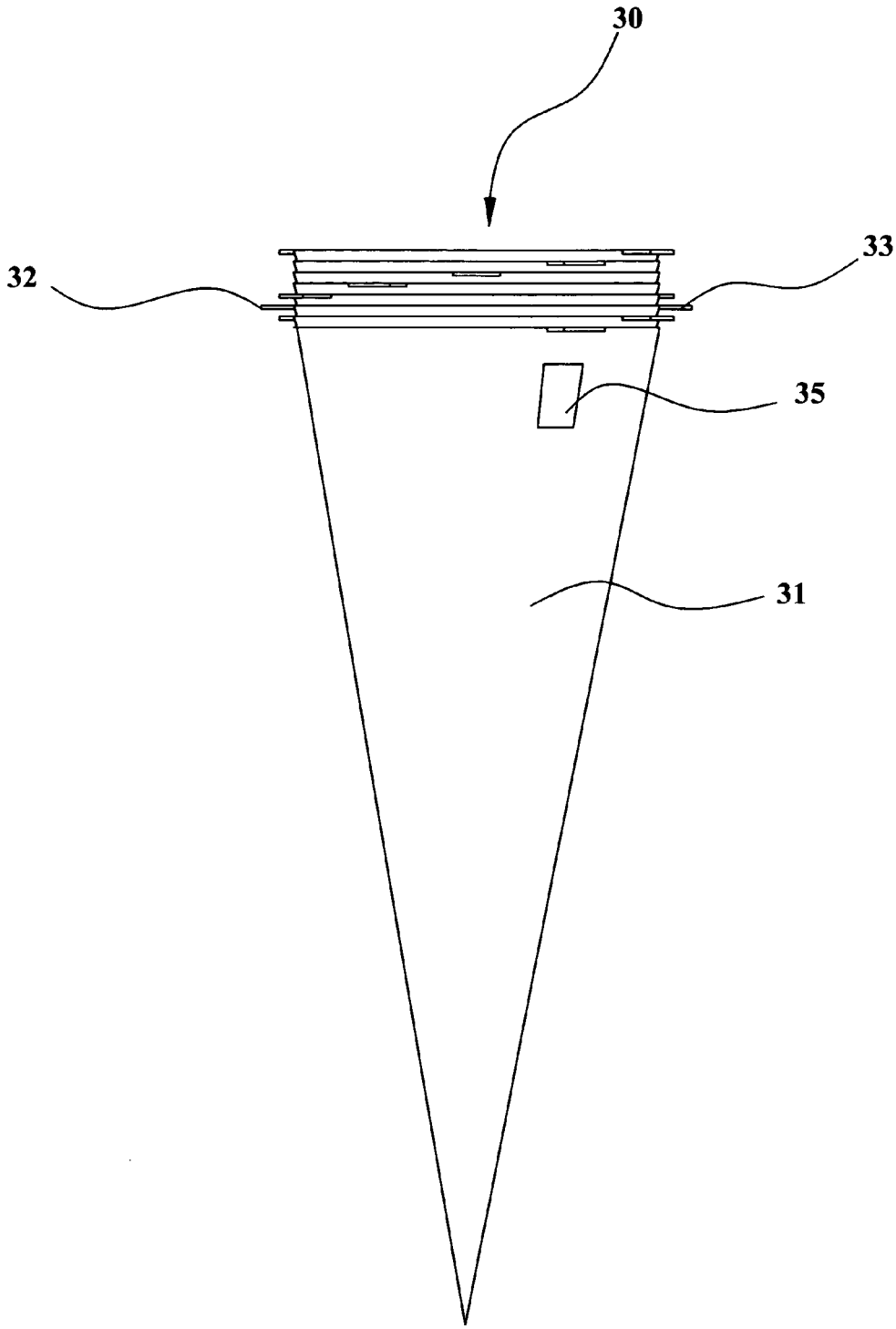
FIG. 4 is a front view illustrating that at least one inserting device is stacked in the golf tee according to the preferred embodiment of the present invention.

FIG. 1 is a perspective view illustrating a golf tee according to a preferred embodiment of the present invention. FIG. 2 is an exploded perspective view illustrating the golf tee according to the preferred embodiment of the present invention. FIG. 3 is a plan view illustrating that at least one inserting device is stacked in the golf tee according to the preferred embodiment of the present invention. FIG. 4 is a front view illustrating that at least one inserting device is stacked in the golf tee according to the preferred embodiment of the present invention.

As illustrated in FIGS. 1 and 2, a golf tee 1 according to the present invention includes a burying device 10 for generating pressure for burial, at least one stacked inserting devices 30 provided under the burying device 10, coupled with the burying device 10, and buried under the ground, and a coupling device 40 for combining the burying device 10 with the inserting device 30.

That is, as illustrated in FIGS. 1 and 2, the burying device 10 includes a concave head portion 11 for retaining a golf ball 50 and a cone 12 extended under the head portion 11 by a predetermined length. At this time, the cone 12 is preferably a hollow portion having a strength which makes it possible to be buried and is preferably made of a thermoplastic resin or a synthetic resin having weight as small as possible.

As illustrated in FIGS. 1 and 2, the inserting device 30 is formed of a cone 31 made of a thin sheet and opened so as to be coupled with the burying device 10. A pair of blocking protrusions 32 and 33 are formed in the outer circumference of the inserting device 30 so as to face each other. Here, in order to make the inserting device 30 of the thin sheet, the inserting device 30 is preferably made of an easily molded synthetic resin and preferably has a strength enough to support the golf ball 50. As illustrated in FIGS. 3 and 4, one or more of the thus formed inserting device 30 are stacked. The blocking protrusions 32 and 33 preferably cross each other when they are stacked.

On the other hand, as illustrated in FIG. 2, a spring 21 and a spring supporting plate 22 for pressing the inserting device 30 downward are formed under the burying device 10.

As illustrated in FIGS. 1 and 2, the coupling device 40 includes a cylindrical body 41 whose upper portion and lower portion are penetrated, a blocking jaw 42 in the inner circumference thereof, a pair of grooves 44 in the blocking jaw 42, which face each other so as to be engaged with the blocking protrusions 32 and 33, and a blocking jaw 43 so as to be smoothly coupled with the burying device 10 in a state where the inserting device 30 are stacked. It is preferable that the burying device 10 and the coupling device 40 be engaged with each other so as not to be easily detached from each other.

Displaying portions 35 and 45 are displayed on one side of the outer circumference of the inserting device 30 so as to be vertical to the blocking protrusions 32 and 33 and one side of the outer circumference of the coupling device 40 that serially coincides with the grooves 44, respectively.

A state in which the golf tee 1 having the above structure is used will now be described in detail with reference to the attached drawings.

Figure 5:
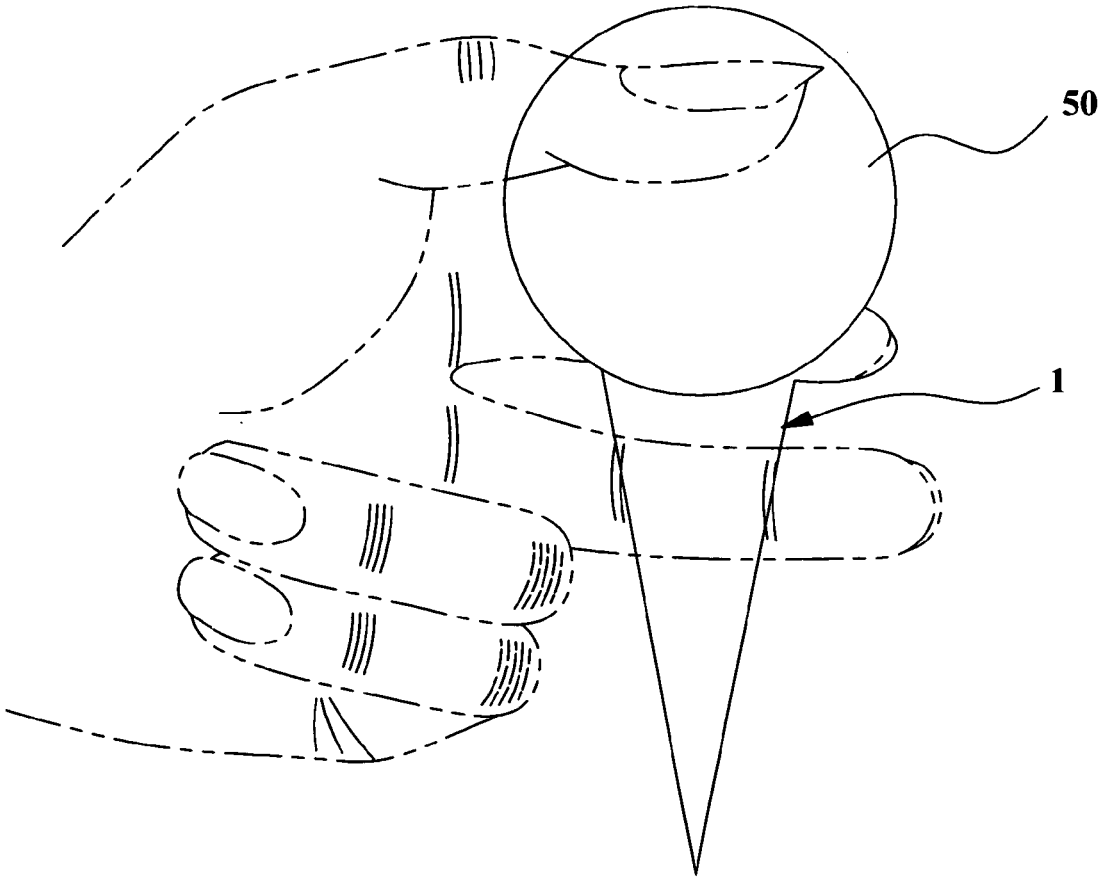
FIG. 5 is a view illustrating a state in which the golf tee according to the preferred embodiment of the present invention is used.
Figure 6:
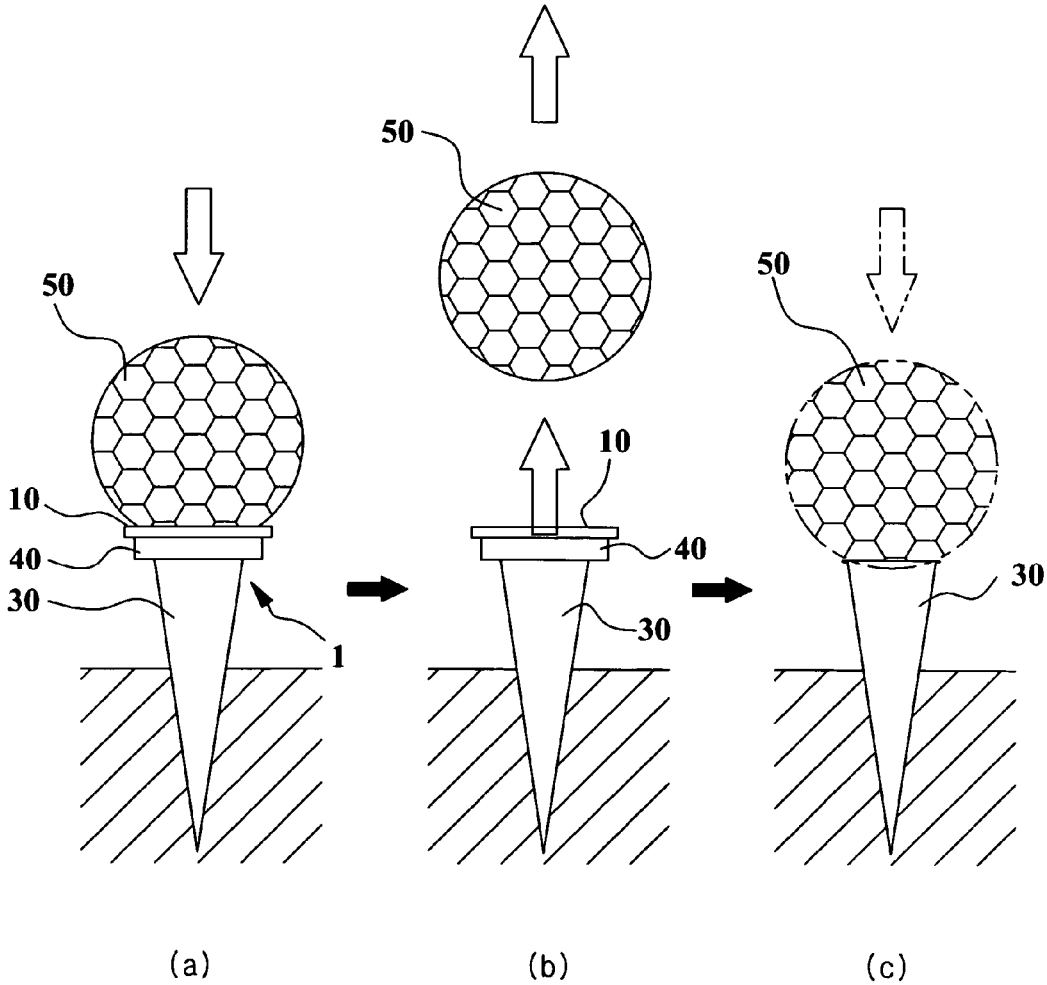
FIG. 6 is a view illustrating a state in which the golf tee according to the preferred embodiment of the present invention is used in each step.

FIG. 5 is a view illustrating a state in which the golf tee according to the preferred embodiment of the present invention is used. FIG. 6 is a view illustrating a state in which the golf tee according to the preferred embodiment of the present invention is used in each step.

As illustrated in FIGS. 2 and 5, a golfer holds the golf tee 1 in a state where the golf ball 50 is put on the golf tee 1. Then, the golfer makes the inserting device 30 coincide with the displaying portions 35 and 45 displayed on the coupling device 40. At this time, the inserting device 30 positioned on the outer most side among the plurality of inserting devices 30 coincides with (or is engaged with) the grooves 44 in a state where the blocking protrusion 32 is detached from the blocking jaw 42 and falls downward. The other inserting devices 30 are attached to the spring 21 in a state where the blocking protrusions 32 and 33 cross each other and are still blocked by the blocking jaw 42.

In this state, when the golf ball 50 and the burying device 10 are removed after burying the golf tee 1 held by the golfer together with the golf ball 50 in the predetermined position of a tee ground as illustrated in FIG. 6, the blocking device 40 coupled with the burying device 10 is detached so that only the inserting device 30 is inserted into the ground.

In this state, when a tee shot is performed with the golf ball 50 put on the inserting device 30, the inserting device 30 made of the thin sheet whose resistance is minimized does not scatter. As a result, no resistance is applied to a club head (not shown).

In particular, it is possible to bury the inserting device 30 by the number of times in which the inserting devices 30 are stacked one by one from the outer most side. Therefore, it is possible to easily bury the inserting device 30 a plurality of times using only one golf tee 1 without additional burying equipments.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

Since the golf tee 1 having the above-mentioned structure is made of the thin sheet material, it is possible to minimize shock so that the golfer can hardly feel resistance when he or she hits the golf ball.

Furthermore, since the burying device 10 for the inserting device 30 made of the thin sheet is integrated with the golf tee 1, it is not necessary to additionally carry the burying equipments and to easily bury the golf tee 1.

Also, since it is possible to stack the plurality of inserting devices 30 in one golf tee 1, it is possible to bury the inserting device 30 a plurality of times by only one golf tee 1 without carrying supplementary golf tees.

What is claimed is:

1. A golf tee comprising:

a burying device including a concave head portion for retaining a golf ball, and a first cone extending from the head portion by a predetermined length;

at least one stacked inserting device including a second cone made of a thin sheet and arranged to receive therein the first cone of said burying device, and at least one blocking protrusion formed in an outer circumference of the second cone;

a spring compressed between said burying device and said at least one stacked inserting device; and a coupling device coupled with the burying device, the coupling device including a cylindrical body with openings in an upper portion and a lower portion thereof sized for said at least one stacked inserting device to pass therethrough, a blocking jaw formed in an inner circumference of said lower portion of the cylindrical body and arranged to engage said at least one blocking protrusion to block passage of said at least one stacked inserting device through the opening in said lower portion, and at least one groove formed in the blocking jaw sized for said at least one blocking protrusion to be released from said blocking jaw when said at least one groove and said at least one blocking protrusion are coincidingly aligned with each other so that said at least one stacked inserting device can pass out of the opening in said lower portion under urging of said compressed spring.

2. The golf tee as claimed in claim 1, further comprising a first displaying portion displayed on the outer circumference of the second cone in a position corresponding to the at least one blocking protrusion, and a second displaying portion displayed on an outer circumference of the coupling device in a position corresponding to the at least one groove.

3. The golf tee of claim 2, wherein said at least one stacked inserting device and said coupling device are positionally adjustable relative to one another so that said first and second displaying portions become aligned to, thereby, have said at least one blocking protrusion coincidingly aligned with said least one groove.

4. The golf tee of claim 3, wherein said at least one stacked inserting device comprises a plurality of nested inserting devices.

5. The golf tee of claim 4, wherein said at least one blocking protrusion comprises a pair of blocking protrusions.

6. The golf tee of claim 5, wherein said pair of blocking protrusions extend radially in opposite directions from the outer circumference of said second cone.

7. The golf tee of claim 6, wherein said at least one groove comprises a pair of grooves arranged correspondingly to said pair of blocking protrusions.

8. The golf tee of claim 1, wherein said at least one stacked inserting device comprises a plurality of nested inserting devices.

9. The golf tee of claim 1, wherein said at least one blocking protrusion comprises a plurality of blocking protrusions.

10. The golf tee of claim 9, wherein said at least one groove comprises a plurality of grooves arranged correspondingly to said plurality of blocking protrusions.

11. The golf tee of claim 9, wherein said plurality of blocking protrusions comprise a pair of blocking protrusions that extend radially in opposite directions from the outer circumference of said second cone.

12. The golf tee of claim 11, wherein said at least one groove comprises a pair of grooves arranged correspondingly to said pair of blocking protrusions.

* * * * *